US005881404A

United States Patent [19]

Knight

[11] Patent Number: 5,881,404

[45] Date of Patent: Mar. 16, 1999

[54] OUTDOORSMAN PORTABLE SINK

[76] Inventor: Greg E. Knight, 309 George Washington Way, Mc Donough, Ga. 30253

[21] Appl. No.: 15,209

[22] Filed: Jan. 29, 1998

[51] Int. Cl.[6] ..... A47K 1/05

[52] U.S. Cl. ..... 4/645; 4/643; 4/619

[58] Field of Search ..... 4/619, 624, 625, 4/626, 643, 645, 650, 654, 620, 621, 627, 631; D23/284, 287

[56] References Cited

U.S. PATENT DOCUMENTS

| | | | |
|---|---|---|---|
| 1,358,937 | 11/1920 | Curliss | 4/626 |
| 2,141,347 | 12/1938 | Davis | 4/654 |
| 4,766,621 | 8/1988 | Rasor | 4/643 |
| 5,182,822 | 2/1993 | Cyr et al. | 4/625 |
| 5,313,676 | 5/1994 | Wright | 4/645 |
| 5,502,848 | 4/1996 | Cowan | 4/619 |

*Primary Examiner*—David J. Walczak

[57] ABSTRACT

An outdoorsman sink including a sink basin having a bottom face with a drain formed therein. A pipe is coupled to a lower surface of the bottom face in communication with the drain. The pipe terminates with a couple for removably connecting with a sewer. The sink basin further includes legs for supporting the sink basin. A faucet is coupled to the sink basin with an associated pipe for removably coupling with a water source.

17 Claims, 2 Drawing Sheets

OUTDOORSMAN PORTABLE SINK

BACKGROUND OF THE INVENTION

1. Field of the Invention

The present invention relates to portable sinks and more particularly pertains to a new outdoorsman portable sink for providing a sink specifically tailored for camping and various other outdoor activities.

2. Description of the Prior Art

The use of portable sinks is known in the prior art. More specifically, portable sinks heretofore devised and utilized are known to consist basically of familiar, expected and obvious structural configurations, notwithstanding the myriad of designs encompassed by the crowded prior art which have been developed for the fulfillment of countless objectives and requirements.

Known prior art portable sinks include U.S. Pat. No. 5,301,376; U.S. Pat. No. 4,766,621; U.S. Pat. No. Des. 250,595; U.S. Pat. No. 4,747,169; U.S. Pat. No. Des. 259, 137; and U.S. Pat. No. Des. 342,121.

In these respects, the outdoorsman portable sink according to the present invention substantially departs from the conventional concepts and designs of the prior art, and in so doing provides an apparatus primarily developed for the purpose of providing a sink specifically tailored for camping and various other outdoor activities.

SUMMARY OF THE INVENTION

In view of the foregoing disadvantages inherent in the known types of portable sinks now present in the prior art, the present invention provides a new outdoorsman portable sink construction wherein the same can be utilized for providing a sink specifically tailored for camping and various other outdoor activities.

The general purpose of the present invention, which will be described subsequently in greater detail, is to provide a new outdoorsman portable sink apparatus and method which has many of the advantages of the portable sinks mentioned heretofore and many novel features that result in a new outdoorsman portable sink which is not anticipated, rendered obvious, suggested, or even implied by any of the prior art portable sinks, either alone or in any combination thereof.

To attain this, the present invention generally comprises a sink basin having a planar rectangular bottom face with a vertical periphery integrally coupled thereto and extending upwardly therefrom to define an upper peripheral edge. The periphery has a planar front face, a planar rear face, and a pair of planar side faces. As shown in FIGS. 1 & 2, the bottom face has a screened drain formed therein. A pipe is coupled to a lower surface of the bottom face in communication with the drain and extending downwardly therefrom. Such pipe terminates in a screwable couple for connecting with a sewer. The bottom face further has a vertically oriented cylindrical leg sleeve coupled adjacent to each corner thereof and extended downwardly therefrom. Further provided is an intermediate leg assembly including four vertically oriented sleeves rigidly interconnected via four support strips which define a square. Each sleeve of the intermediate leg assembly is removably coupled in coaxial alignment at a top end thereof with a bottom end of an associated one of the leg sleeves of the sink basin. A plurality of cylindrical legs are slidably received within the vertically oriented sleeves of the intermediate leg assembly. Each leg is adapted to be selectively fixed with respect to the intermediate leg assembly for allowing the adjustment of a height of the sink basin. FIGS. 1 & 2 best show a horizontally oriented rear lip having a planar rectangular configuration. This lip is coupled to the upper peripheral edge along the rear face of the sink basin and is extended rearwardly therefrom. The lip has a top surface with a first end including a small rectangular recess for containing a bar of soap. A plurality of vertical bores are extended through the lip adjacent the small rectangular recess for containing a plurality of toothbrushes. A second end of the top surface of the lip is equipped with a large rectangular recess. A central extent of the lip has a faucet coupled thereto and extended above the sink basin. The lip further includes a lower surface with a water inlet tube coupled thereto and extended downwardly therefrom for coupling with a water source. Connected between the faucet and the water inlet tube is a valve for selectively controlling the flow of water from the faucet. Also included is a paper towel assembly having a pair of vertically oriented square plates coupled to one of the side faces of the sink basin. Such square plates extend outwardly from the associated side face of the sink basin and are equipped with a pair central bores for releasably receiving a horizontally oriented dowel. Finally, a cloth towel holder is provided including a long cylindrical bar coupled in parallel with one of the side faces opposite the paper towel assembly. This is accomplished via a pair of arms coupled between the corresponding side face and ends of the cylindrical bar.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new outdoorsman portable sink apparatus and method which has many of the advantages of the portable sinks mentioned heretofore and many novel features that result in a new outdoorsman portable sink which is not anticipated, rendered obvious, suggested, or even implied by any of the prior art portable sinks, either alone or in any combination thereof.

It is another object of the present invention to provide a new outdoorsman portable sink which may be easily and efficiently manufactured and marketed.

It is a further object of the present invention to provide a new outdoorsman portable sink which is of a durable and reliable construction.

An even further object of the present invention is to provide a new outdoorsman portable sink which is susceptible of a low cost of manufacture with regard to both materials and labor, and which accordingly is then susceptible of low prices of sale to the consuming public, thereby making such outdoorsman portable sink economically available to the buying public.

Still yet another object of the present invention is to provide a new outdoorsman portable sink which provides in the apparatuses and methods of the prior art some of the advantages thereof, while simultaneously overcoming some of the disadvantages normally associated therewith.

Still another object of the present invention is to provide a new outdoorsman portable sink for providing a sink specifically tailored for camping and various other outdoor activities.

Even still another object of the present invention is to provide a new outdoorsman portable sink that includes a sink basin having a bottom face with a drain formed therein. A pipe is coupled to a lower surface of the bottom face in communication with the drain. The pipe terminates with a couple for removably connecting with a sewer. The sink basin further includes legs for supporting the sink basin. A faucet is coupled to the sink basin with an associated pipe for removably coupling with a water source.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
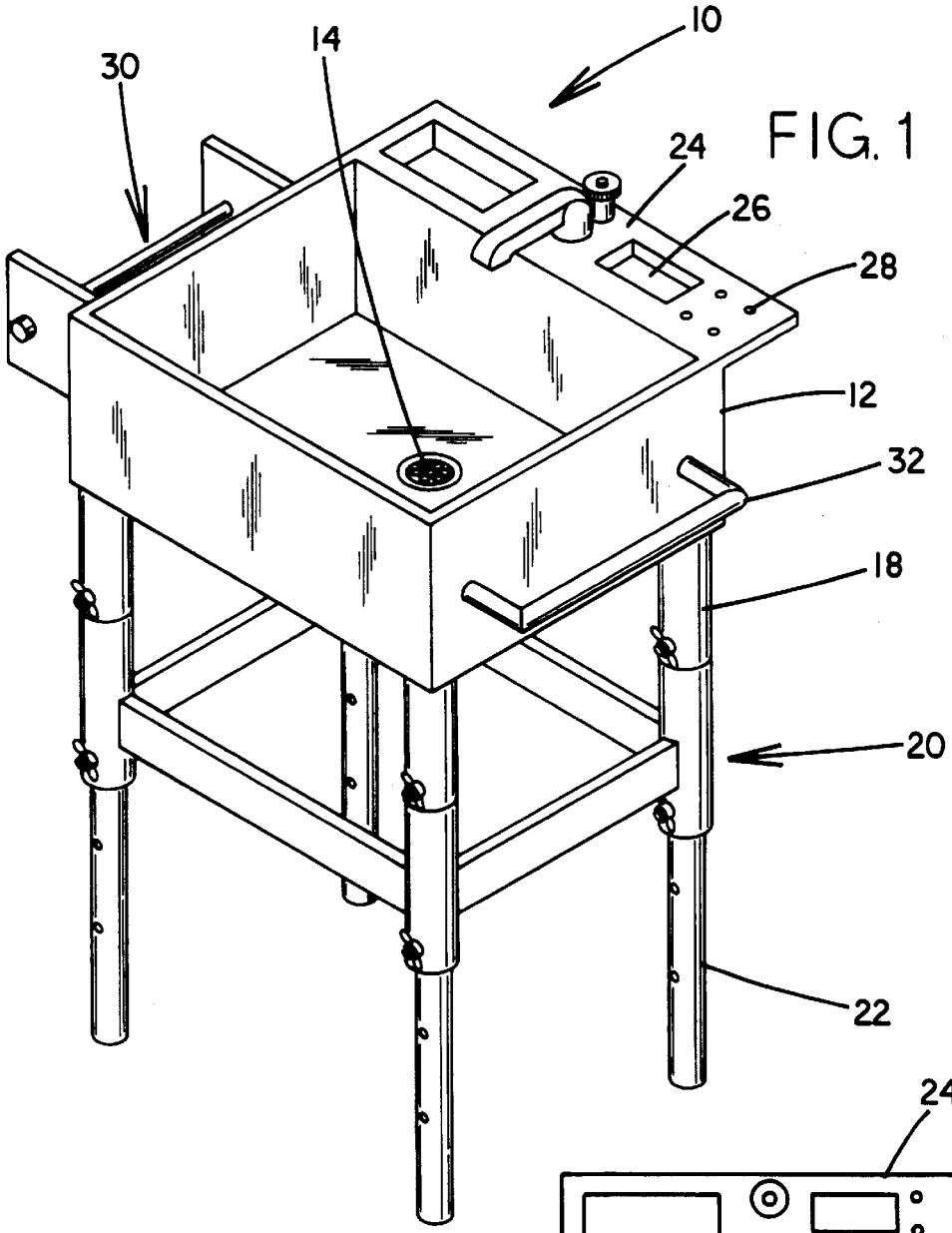
FIG. 1 is a perspective view of a new outdoorsman portable sink according to the present invention.

With reference now to the drawings, and in particular to FIGS. 1 through 4 thereof, a new outdoorsman portable sink embodying the principles and concepts of the present invention and generally designated by the reference numeral 10 will be described.

The present invention, designated as numeral 10, includes a plastic sink basin 12 having a planar rectangular bottom face with a vertical periphery integrally coupled thereto and extending upwardly therefrom to define an upper peripheral edge. The periphery has a planar front face, a planar rear face, and a pair of planar side faces.

Figure 2:
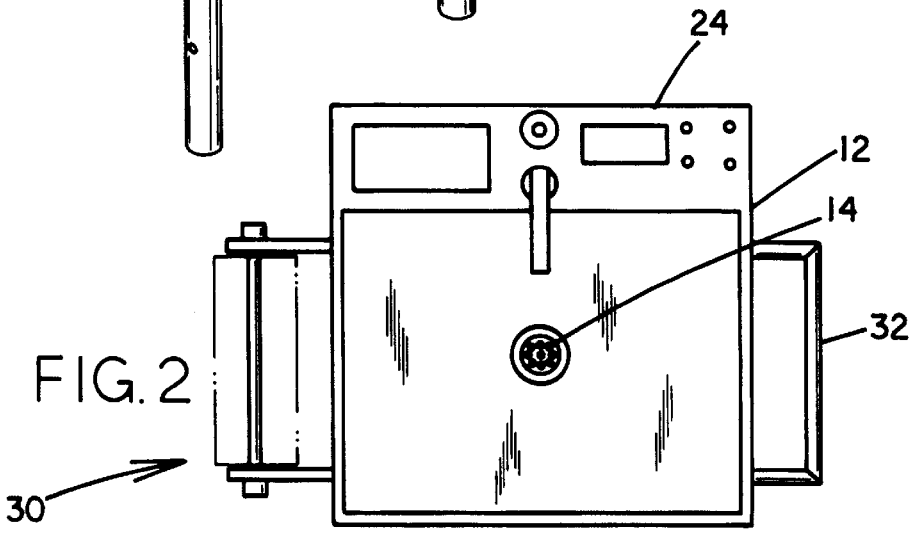
FIG. 2 is a top view of the present invention.
Figure 3:
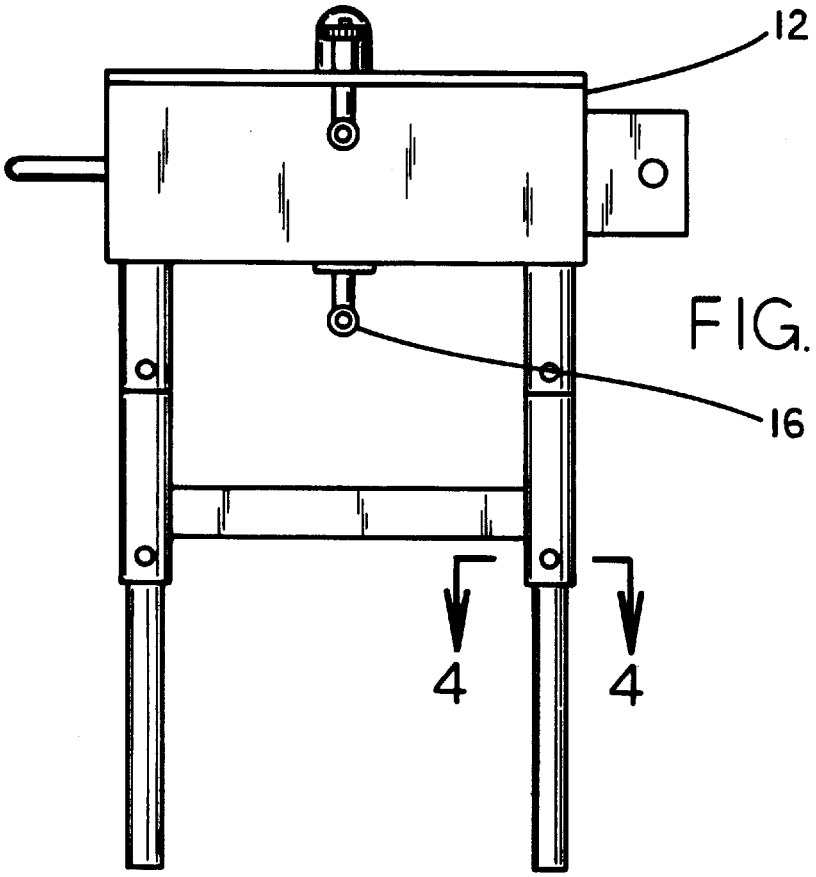
FIG. 3 is a front view of the present invention.
Figure 4:
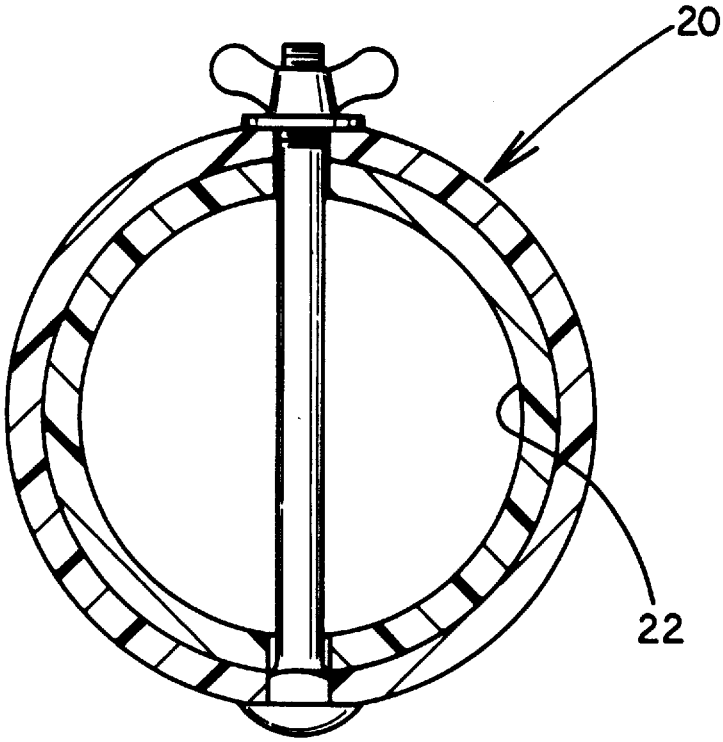
FIG. 4 is a cross-sectional view of one of the legs of the present invention taken along line 4—4 shown in FIG. 3.

As shown in FIGS. 1 & 2, the bottom face has a screened drain 14 formed therein. A rigid water outlet pipe 16 is coupled to a lower surface of the bottom face in communication with the drain and extended downwardly therefrom. Such water outlet pipe preferably extends downwardly from the sink basin less than ¼ a height of the sink. The water outlet pipe 16 terminates in a screwable couple for connecting with a sewer via a house or the like. The bottom face further has a vertically oriented cylindrical leg sleeve 18 coupled adjacent to each corner thereof and extended downwardly therefrom.

Further provided is an intermediate leg assembly 20 including four vertically oriented sleeves rigidly interconnected via four support strips which define a square. A height of each sleeve is equal to that of the sink basin. Each sleeve of the intermediate leg assembly is removably coupled in coaxial alignment at a top end thereof with a bottom end of an associated one of the leg sleeves of the sink basin. Each of the forgoing couplings is afforded by way of diametrically opposed apertures and a bolt and wing nut combination.

A plurality of cylindrical legs 22 are slidably received within the vertically oriented sleeves of the intermediate leg assembly. Each leg is adapted to be selectively fixed with respect to the intermediate leg assembly for allowing the adjustment of a height of the sink basin. It should be noted that the cylindrical legs are coupled to the intermediate leg assembly in a similar manner as that of the coupling between the intermediate assembly and the leg sleeves of the sink basin. Note FIG. 4. The legs, however, are each further equipped with multiple pairs of linearly aligned diametrically opposed apertures.

FIGS. 1 & 2 best show a horizontally oriented rear lip 24 having a planar rectangular configuration. This lip is coupled to the upper peripheral edge along the rear face of the sink basin and is extended rearwardly therefrom. The lip has a top surface with a first end including a small rectangular recess 26 for containing a bar of soap. A plurality of vertical bores 28 are extended through the lip adjacent the small rectangular recess for containing a plurality of toothbrushes. A second end of the top surface of the lip is equipped with a large rectangular recess. A central extent of the lip has a faucet coupled thereto and extended above the sink basin. The lip further includes a lower surface with a water inlet tube coupled thereto and extended downwardly therefrom for coupling with a water source. It should be noted that both the water inlet pipe and outlet tube each extend rearwardly for access adjacent to a rear of the sink basin. Connected between the faucet and the water inlet tube is a valve for selectively controlling the flow of water from the faucet.

Also included is a paper towel assembly 30 having a pair of vertically oriented square plates coupled to one of the side faces of the sink basin. Such square plates extend outwardly from the associated side face of the sink basin and are each equipped with a pair central bores for releasably receiving a horizontally oriented dowel.

Finally, a cloth towel holder 32 is provided including a long cylindrical bar coupled in parallel with one of the side faces opposite the paper towel assembly. This is accomplished via a pair of arms coupled between the corresponding side face of the sink basin and ends of the cylindrical bar.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An outdoorsman sink comprising, in combination:

a sink basin including a planar rectangular bottom face with a vertical periphery integrally coupled thereto and extending upwardly therefrom to define an upper peripheral edge, the periphery having a planar front face, a planar rear face, and a pair of planar side faces, the bottom face having a screened drain formed therein with a pipe coupled to a lower surface of the bottom face in communication with the drain and extending downwardly therefrom with the pipe terminating in a screwable couple for connecting with a sewer, the bottom face further having a vertically oriented cylindrical leg sleeve coupled adjacent to each corner thereof and extending downwardly therefrom;

an intermediate leg assembly including four vertically oriented sleeves rigidly interconnected via four support strips which define a square, each sleeve of the intermediate leg assembly being removably coupled in coaxial alignment at a top end thereof with a bottom end of an associated one of the leg sleeves of the sink basin;

a plurality of cylindrical legs slidably received within the vertically oriented sleeves of the intermediate leg assembly, each leg adapted to be selectively fixed with respect to the intermediate leg assembly for allowing the adjustment of a height of the sink basin;

a horizontally oriented rear lip having a planar rectangular configuration, the lip coupled to the upper peripheral edge along the rear face of the sink basin and extending rearwardly therefrom, the lip having a top surface with a first end including a small rectangular recess for containing a bar of soap and a plurality of vertical bores extended therethrough for containing a plurality of toothbrushes, the top surface of the lip further having a second end with a large rectangular recess, a central extent of the lip having a faucet coupled thereto and extending above the sink basin, the lip further including a lower surface with a water inlet tube coupled thereto and extending downwardly therefrom for coupling with a water source, wherein a valve is connected between the faucet and the water inlet tube;

a paper towel assembly including a pair of vertically oriented square plates coupled to one of the side faces of the sink basin and extending outwardly therefrom each with a pair central bores for releasably receiving a horizontally oriented dowel; and a cloth towel holder including a long cylindrical bar coupled in parallel with one of the side faces opposite the paper towel assembly via a pair of arms coupled between the corresponding side face and ends of the cylindrical bar.

2. An outdoorsman sink comprising:

a sink basin including a bottom face having a drain formed therein with a pipe coupled to a lower surface of the bottom face in communication with the drain with the pipe terminating in a couple for removably connecting with a sewer, the sink basin further including legs means for supporting the sink basin; and a faucet coupled to the sink basin with an associated pipe for removably coupling with a water source;

wherein the pipes of the drain and the faucet each have a lower end which is positioned about a horizontal axis and faces rearwardly, the lower end of the pipe of the faucet terminating in a couple, each of the couples of the pipes of the drain and faucet being adapted for threadedly coupling to the sewer and water source, respectively; and wherein the leg means includes a removable intermediate leg assembly including four vertically oriented sleeves rigidly interconnected via support strips.

3. An outdoorsman sink as set forth in claim 2 wherein the sink basin has a rectangular configuration.

4. An outdoorsman sink as set forth in claim 2 wherein the sink basin has a rearwardly extending lip coupled to an upper peripheral edge thereof.

5. An outdoorsman sink as set forth in claim 4 wherein the lip has at least one recess formed therein.

6. An outdoorsman sink as set forth in claim 4 wherein the lip has at least one vertical aperture formed therein for containing a toothbrush.

7. An outdoorsman sink as set forth in claim 2 and further including a paper towel assembly coupled to one side face of the sink basin.

8. An outdoorsman sink as set forth in claim 2 and further including a cloth towel holder coupled in parallel with one side face of the sink basin.

9. An outdoorsman sink as set forth in claim 2 wherein the leg means includes removable legs.

10. An outdoorsman sink comprising:

a sink basin including a bottom face having a drain formed therein with a pipe coupled to a lower surface of the bottom face in communication with the drain with the pipe terminating in a couple for removably connecting with a sewer, the sink basin further including legs for supporting the sink basin; and a faucet coupled to the sink basin with an associated pipe for removably coupling with a water source;

wherein the legs each include an upper extent mounted to the sink basin and extending downwardly therefrom;

wherein the legs include an intermediate assembly including four support strips interconnected to form a square, wherein the intermediate assembly is removably coupled to the upper extent of the legs;

wherein the legs each include a lower extent coupled to the intermediate assembly and extending downwardly therefrom for supporting the sink basin.

11. An outdoorsman sink as set forth in claim 10 wherein the pipes of the drain and faucet are adapted for being screwably coupled to the sewer and water source, respectively.

12. An outdoorsman sink as set forth in claim 10 wherein the sink basin has a rectangular configuration.

13. An outdoorsman sink as set forth in claim 10 wherein the sink basin has a rearwardly extending lip coupled to an upper peripheral edge thereof.

14. An outdoorsman sink as set forth in claim 13 wherein the lip has at least one recess formed therein.

15. An outdoorsman sink as set forth in claim 13 wherein the lip has at least one vertical aperture formed therein for containing a toothbrush.

16. An outdoorsman sink as set forth in claim 10 and further including a paper towel assembly coupled to one side face of the sink basin.

17. An outdoorsman sink as set forth in claim 10 and further including a cloth towel holder coupled in parallel with one side face of the sink basin.

* * * * *